US007819346B2

(12) United States Patent
Perkes

(10) Patent No.: US 7,819,346 B2
(45) Date of Patent: Oct. 26, 2010

(54) PROCESS FOR ACCELERATING THE WETTING OF AND THE APPLICATION OF SALT TO SURFACES

(76) Inventor: Rex W Perkes, 4024 Laurel Dr., West Richland, WA (US) 99353

( * ) Notice: Subject to any disclaimer, the term of this patent is extended or adjusted under 35 U.S.C. 154(b) by 92 days.

(21) Appl. No.: 11/970,480

(22) Filed: Jan. 7, 2008

(65) Prior Publication Data

US 2009/0173800 A1 Jul. 9, 2009

(51) Int. Cl.
*A01C 23/00* (2006.01)

(52) U.S. Cl. ..... 239/662; 239/656; 239/658; 239/675

(58) Field of Classification Search ..... 239/650, 239/675, 656, 658, 662, 674, 668, 677, 665
See application file for complete search history.

(56) References Cited

U.S. PATENT DOCUMENTS

| | | | | | |
|---|---|---|---|---|---|
| 1,158,503 | A * | 11/1915 | Johnston | 404/75 |
| 3,084,942 | A * | 4/1963 | Kucera | 239/658 |
| 3,420,451 | A * | 1/1969 | Kahlbacher | 239/666 |
| 3,717,285 | A * | 2/1973 | Hatton | 222/136 |
| 5,069,392 | A * | 12/1991 | Wise et al. | 239/675 |
| 5,186,396 | A * | 2/1993 | Wise et al. | 239/675 |
| 5,267,696 | A * | 12/1993 | Balmer | 239/662 |
| 5,501,403 | A * | 3/1996 | van Vooren | 239/662 |
| 5,931,393 | A * | 8/1999 | Alsip et al. | 239/654 |
| 6,024,033 | A * | 2/2000 | Kinkead et al. | 111/11 |
| 6,173,904 | B1 * | 1/2001 | Doherty et al. | 239/1 |
| 6,193,175 | B1 * | 2/2001 | Andersson et al. | 239/656 |
| 6,535,141 | B1 * | 3/2003 | Doherty | 340/905 |
| 6,659,376 | B2 * | 12/2003 | Savard | 239/650 |
| 6,932,286 | B2 * | 8/2005 | Smith et al. | 239/650 |
| 6,938,829 | B2 * | 9/2005 | Doherty et al. | 239/1 |
| 7,370,818 | B2 * | 5/2008 | Ward et al. | 239/662 |
| 7,380,733 | B2 * | 6/2008 | Owenby et al. | 239/656 |
| 2007/0034721 | A1 * | 2/2007 | Owenby et al. | 239/656 |

* cited by examiner

*Primary Examiner*—Len Tran
*Assistant Examiner*—Trevor E McGraw
(74) *Attorney, Agent, or Firm*—Floyd E. Ivey

(57) ABSTRACT

The salt slurry clump forming apparatus and process comprise an auger receiving salt and atomized liquid to form a slurry which is deposited on a broadcast spreader to form slurry clumps of generally 0.25" to 1.25" in diameter. Slurry clumps resist movement from roadway and other surfaces by wind and vehicle traffic and deter bonding of ice and snow with a surface. Multiple applications are lessened and road work in removal of ice and snow is facilitated.

12 Claims, 2 Drawing Sheets

PROCESS FOR ACCELERATING THE WETTING OF AND THE APPLICATION OF SALT TO SURFACES

FIELD OF THE INVENTION

This invention relates to a process for wetting and applying salt to roadways and other surfaces in the event of icy or snow weather conditions.

BACKGROUND OF THE INVENTION

Studies done by the U.S. Department of Transportation Federal Highway Administration have determined that packed snow and ice on the roadway constitute a major road hazard to motorists. There are numerous ways of dealing with this problem with cost and effectiveness varying.

Low cost salt applications can work well in favorable weather and traffic conditions. The application of dry salt is subjected to the hazard of being removed from a surface by both wind and air forces created by traffic. Breezes of 5 mph have been shown to remove salt from a roadway. It has been documented that the air forces created by just three trucks, traveling on a roadway after salt has been applied, will move applied salt material from the application site. Likewise, twelve cars following a salt truck will create enough air movement to move the salt applied from the site of application. Road maintenance personnel have observed roadways where the side of the road is free from snow and ice while the roadway still has compact snow and ice. Such occurs where the salt that has been applied to the roadway has drifted, bounced or migrated off the intended surface area to the side of the road. These conditions necessitate multiple applications to achieve a desirable application of salt. In many instances, the road maintenance worker increases the amount of salt that is applied in successive applications. This increases application costs, raw material costs and the accumulated salts become harmful to the environment. The invention disclosed and claimed herein provides a solution to these road maintenance issues.

The patents referred to herein are provided herewith in an Information Disclosure Statement in accordance with 37 CFR 1.97.

SUMMARY OF THE INVENTION

The purpose of applying salt to a roadway is not to melt the ice and snow, but rather, to break the bond that the ice has with the pavement. Once that bond is broken snow plows can readily remove the ice and packed snow. The problem that we are addressing is how to ensure the applied salts will remain in place long enough to break the ice/pavement bond. To help us understand how this can be accomplished, it is helpful to understand the cubic crystalline composition of salt. A salt cube coming to rest on an icy surface has only $1/6^{th}$ of its surface area in contact with the ice. Time is a critical aspect in breaking the ice/pavement bond; time is required before the salt and ice begin to react and start the melting process. This required time period is interrupted when salts are blown or bounced from the roadway. Over the past fifty years or so, highway departments and roadway workers have tried several different methods to expedite breaking the ice/pavement bond.

One method was to spray water on the salt stores that the highway departments had stockpiled. This generally resulted in a solid block of salt rather than producing a salt form which was efficient in addressing the problem. Road workers have also sprayed individual salt loads with water. The application of salt thus wetted performed better but yielded inconsistent results. Manufacturers have since mounted spray nozzles to their trucks, wetting the ground before the salt lands on the ice with marginal results. Another popular method used today is to introduce water to the salt in the instant it is being applied to the roadway. The problem with these current methodologies is that they fail to take into consideration the basic salt crystal structure. As a six sided cube, much of the salt's surface never comes into contact with the liquid under the current strategies. In fact, the primary problem has still not been addressed as salt continues to migrate from its intended location.

The process claimed herein is the deposition of salt "clumps" on the surfaces to be treated. A salt "clump" resists movement caused by wind and allows the salt so deposited to exist between the road surface and the subsequent snow or ice formation.

BRIEF DESCRIPTION OF THE DRAWINGS

FIG. 2 illustrates the delivery of salt (50) to the auger (100) via a chute (54).

FIGS. 3 and 4 illustrate delivery of salt (50) flowing from the salt container (53). FIG. 2 also illustrates the auger (100) within a auger container (140) shielded from salt (50) with exception of by delivery from the chute (54). Also seen is a cover (56), an air space (58), a pipe (200) and a nozzle (220).

FIG. 4 illustrates the apparatus with a single auger (100).

DETAILED DESCRIPTION

Figure 1:
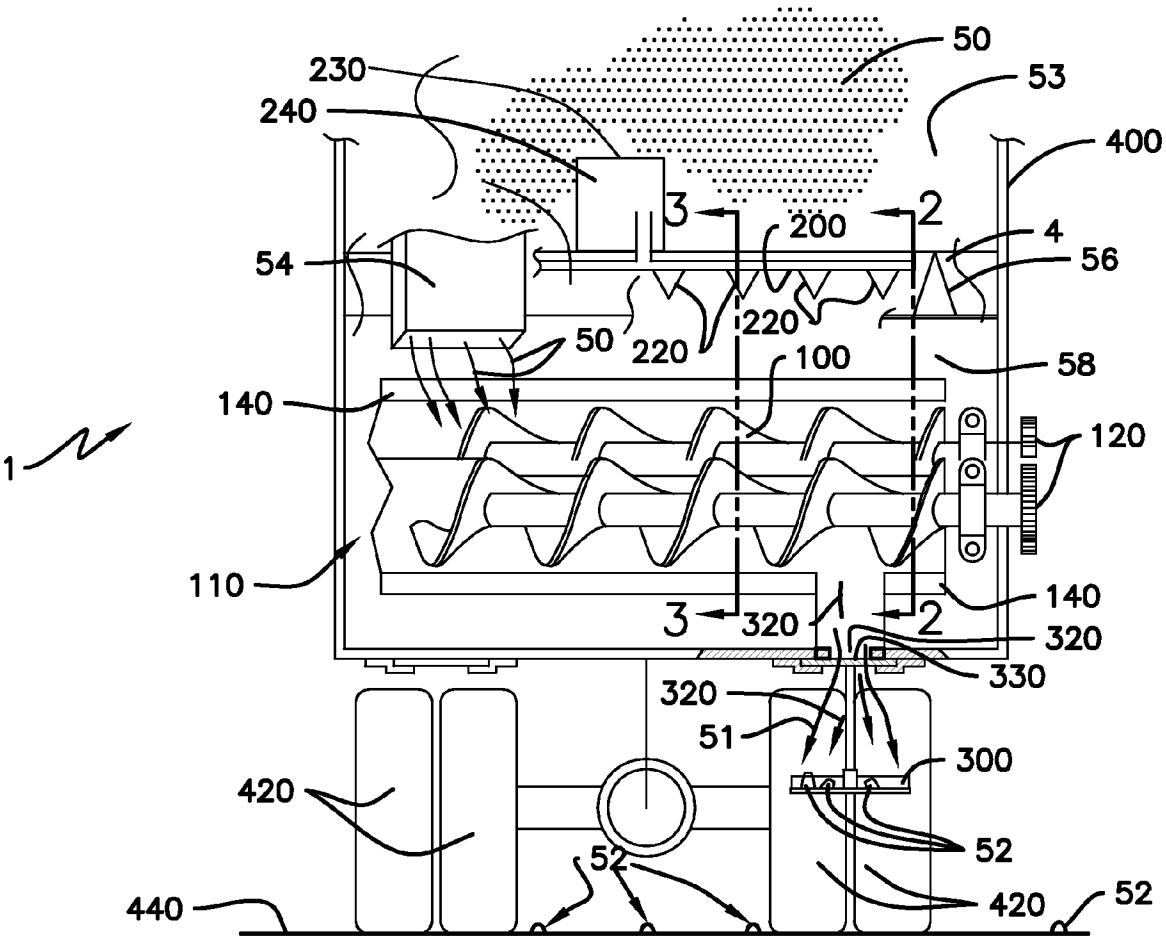
FIG. 1 illustrates an apparatus compatible with the process claimed herein comprising a container (400), salt (50), a salt delivery chute (54), augers (100), an auger drive (120), a pipe (200), nozzles (220), a broadcast spreader (300), and tires (420).
Figure 3:
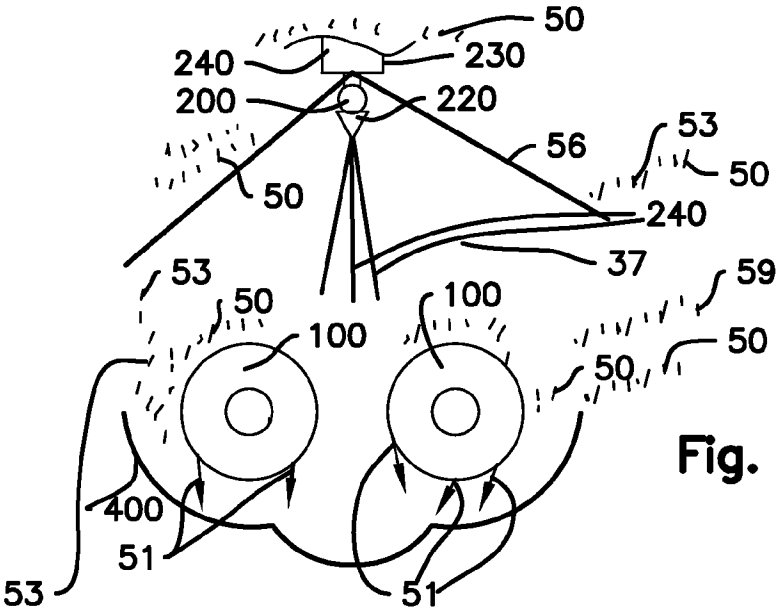
FIGS. 2, 3 and 4 are sections from FIG. 1 illustrating the auger (100), the cover (56), liquid container (230) and liquid (240).
Figure 2:
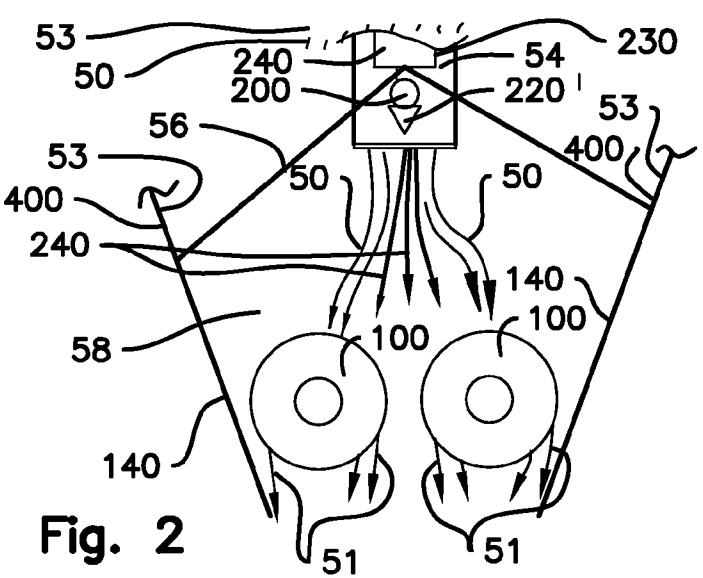
Figure 4:
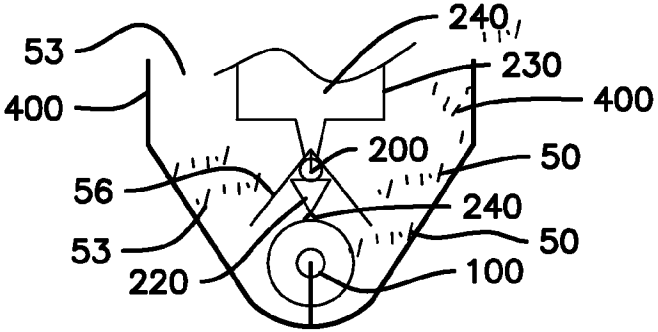

The foregoing and other features and advantages of the present invention will become more readily appreciated as the same become better understood by reference to the following detailed description of the preferred embodiment of the invention when taken in conjunction with the accompanying drawings, wherein:

FIG. 1 illustrates a slurry clump (52) spreading apparatus claimed and compatible with the process described herein. Seen is generally is a truck bed (400) having a salt container (53), containing salt (50). Salt is delivered by a variety of means and here is represented solely by a salt delivery chute (54) which meters salt (50) to at least one auger (100). In the preferred embodiment two augers (100) are utilized operating cooperatively to mix the delivered salt (50). The auger (100) is contained in an auger container (140). Positioned above the augers is a pipe (200) or pipe (200) system with at least one nozzle (220). In the preferred embodiment there are multiple nozzles (220). A cover (56) is positioned over the pipe (200), auger (100) and auger container (140). A liquid, generally water, is delivered to the pipe (200) by a liquid supply (240) which is generally pressurized. The auger (100) is rotated by an auger drive (120). The salt (50) introduced to the auger (100) or augers (100) is wetted by liquid (240) sprayed onto the salt (50) as it is mixed and propelled by the augers (100), producing a slurry (51), to a wetted salt outlet (320) from the auger container (140) and through the container wetted salt outlet (330) where the slurry (51) is then deposited on a broadcast spreader (300). The wetted salt outlet (320), from the auger container (140), and the container wetted salt outlet (330) are generally apertures. The container (400) is generally supported by a truck having tires (420). Salt (50) may be comprised of NaCl or combinations of NaCl and $CaCl_2$. Salt (50) here encompasses all deicing materials including crystalline forms. Salt delivered by prior art salt delivery systems, spreading dry salt, will become wetted as salt crystals are in contact with ice, snow, rain etc. The apparatus and process disclosed and claimed herein creates accelerated wetting of the salt (50) such that the salt (50) is wet when it is initially deposited on the surface (440).

Spray nozzles (220) are placed under a protective cover (56) and over an auger (100) system comprised of the auger (100) and auger container (140). The cover (56) provides an environment where the salt (50) and liquid (240) can mix as well as protecting the auger (100) from the weight of the surrounding salt (50). Air space (58) is created between the cover (56) and the salt (50) allowing the spray nozzle (220) to atomize the liquid (240) across the salt (50) crystals. The auger (100) is needed so that the salt (50) crystals can be completely covered, on all 6 sides, with liquid (240). The salt (50) is thus wetted as liquid (240) is sprayed or atomized onto the auger (100) which is receiving and propelling salt (50). In the preferred embodiment the salt (50) is sprayed with liquid (240) for at least 2 turns of the auger (100) in order to mix the salts (50) crystals with liquid (240). The recommended ratio of liquid (240) to salt (50) is 15 to 30 gallons of liquid (240) per ton of salt (50). The required liquid (240) content will change depending on the moisture of the salt (50) and the ambient moisture. The amount of time that elapses between the introduction of liquid (240) to the salt (50) and application to a road surface (440) has a dramatic impact on the effectiveness of the resulting wetted salt (50) solution. Systems utilized by modern Department of Transportation salt delivery vehicles will control the quantity of liquid (240), the quantity of salt (50), the time the salt (50) is exposed to atomized liquid (240) and the operation of the broadcast spreader (300) by the use of electronic metering equipment which controls the ratio of liquid (240) to salt (50) and the speed at which the wetted salt slurry (51) mixture is applied to ensure optimum performance. However, the metering of liquid (240) and salt (50) may be by operator observation which can be facilitated by timing of release of a quantity of liquid (240) while releasing a quantity of salt (50). Also, changing road and weather conditions will require adjustments to the rate of delivery of slurry (51) to the surface. In the preferred embodiment of the process, research and observations indicate that the preferred application will be 40 gallons of liquid (240) per ton of salt (50), applied at a rate of 40 lbs of salt (50) per mile.

The nozzle (220) size and pressure of liquid (240) determines the extent of wetting of salt (50) and the extent to which salt (50) has commenced to dissolve. Observations, and research, demonstrates that 0.050" nozzles receiving liquid (240) at 20 psi will deliver 1 gallon of liquid per mile. In the preferred embodiment the nozzles (220) are set about two inches above the top of the auger (100). This separation allows the spray to atomize, thus being more efficient in wetting most to all of the salt (50) crystals.

A time requirement is the timing of the two auger (100) turns on average required to begin the melting process of the salt (50). The resulting slurry (51) will solidify in time and hence must be applied, via the broadcast spreader (300) shortly after wetting of the salt (50). Years of liquid chemical application to dry material has demonstrated that a minimum of two turns of an auger (100) will cause all salt (50) particles to mix or blend. More turns will continue the blending process to produce the desired slurry (51), however, two turns allows sufficient blending to begin the melting process. In the preferred embodiment the operator will frequently observe the state of the slurry (51) delivered to the surface. Such observation will allow the operator to adjust the mix of liquid (240) to salts (50) at regular intervals. Each load of salt (50) has a different percentage of moisture. The weather will differ with each trip and during each trip. Hence, frequent observations and adjustments by the operator are required to maintain the slurry (51) at the desired consistency.

The ultimate goal is the formation of slurry clumps (52) to be deposited on the surface (440). Wetting the salt (50) produces slurry (51) which, when wetted sufficiently, forms slurry clumps (52) which is deposited on the broadcast spreader (300). Slurry clumps (52) are created by wetting salt (50) and conversion of dry salt (50) crystals to slurry (51) which, when wetted sufficiently forms slurry clumps (52). The operator will maintain adjustment of quantity of salt (50) and quantity of liquid (240) to insure the deposition of slurry clumps (52) on the surface (440). The slurry clumps (52) are delivered to the broadcast spreader (300), which is spun by a conventional means, thereby depositing the slurry clumps (52) on the surface (440) by means of the centrifugal force imposed on the slurry clumps (52). Slurry clump (52) size will vary from small droplets to golf ball size clumps (52) generally in a range of 0.1" to 1.25" in diameter. The clump (52) is an irregular shape but, for convenience is here limited by the expression of a diameter. In the preferred embodiment the slurry clump (52) delivered to the surface (440) will be in the range of 0.25" to 1.25" in diameter. Observations of an operator may be directed to viewing clump (52) sizes of about the of marbles. Slurry clumps (52) of the preferred size are dependent on the ratio of dry salt (50) to liquid (240) and the rate of rotation of the broadcast spreader (300). Higher rates of rotation of the broadcast spreader (300) produces smaller diameter slurry clumps (52).

In the preferred embodiment the preferred ratio is one ton of dry road salt (50) to 40 gallons of water (240). The operator will be required to observe the size of slurry clumps (52) and adjust the combination of the ratio of salt (50) to liquid (240) and the rate of rotation of the broadcast spreader (300) to maintain the consistent application of slurry clumps (52) of the desired size. Generally, each truck used for such road maintenance has controls for rate of rotation of the broadcast spreader (300), the pressure of delivered liquid (240) and the delivery rate of salt (50). A practice is observed that an operator, in approaching an intersection, will increase the volume of the slurry (51) mixture and increase the rotation rate of the broadcast spreader (300) resulting in the spreading of slurry clumps (52) over a larger area. Newer trucks may also have radar detection of the slurry clumps (52) which provides additional data for the operator to adjust the flow of slurry (51) and rotation rate of the broadcast spreader (300) based on the speed of the truck.

Experiences in the delivery of slurry clumps (52) indicates that a slurry clump (52) with the consistency of cooked oatmeal will be a consistency for average conditions. The indicated consistency and size of slurry clumps (52), providing desirable efficiency in reducing bonding of ice and snow to the roadway and in producing a result corresponding to that disclosed herein, results from testing done on state and local roadways, as well as on private and public lots. Testing performed was observed by roadway maintenance personnel who found the results superior to the other methods of application of salt (50). Cost savings of approximately 200% were estimated by the avoidance of multiple applications. This estimate was an observation from District Supervisors for the Washington State Highway Department.

Claimed herein is an apparatus and a process. The apparatus is a slurry clump (52) spreading apparatus (1) comprised of a container (400), generally a truck bed, containing salt (50) in a salt container (53); a salt delivery chute (54) which meters salt (50) from the container (400) to at least one auger (100); the at least one auger (100) may be comprised of at least two augers (100); the at least one auger (100) contained in an auger container (140), shielded from salt (50) within the salt container (53) or not in an auger container (140) receiving salt (50) directly from the salt container (53); the auger (100) has a cover (56) positioned above the at least one auger (100), within the cover (56) is a pipe (200) or pipe (200) system with at least one nozzle (220) downwardly directed toward the at least one auger (100); the at least one nozzle may be multiple nozzles (220); the cover (56) is positioned over the pipe (200), auger (100) and auger container (140); the cover (56) and auger container (140) shields the at least one auger (100) from the introduction of salt (50) other than by delivery from a salt delivery chute (54); the salt delivery chute (54), the auger container (140) and cover (56) are composed of rigid materials generally metal; a liquid container (230) contains a liquid (240), generally water, which is delivered to the pipe (200); the liquid (240) is generally pressurized and is in liquid communication via the pipe (200) with the at least one nozzle (220); the auger (100) is rotated by an auger drive (120); the salt (50) is introduced to the at least one auger (100) or augers (100), by the salt delivery chute (54), is wetted by liquid (240) sprayed, by the at least one nozzle (220) onto the salt (50) as it is mixed and propelled by the augers (100), producing a slurry (51), to a wetted salt outlet (320) from the auger container (140) and through a container wetted salt outlet (330) where the slurry (51) is then deposited on a rotatable broadcast spreader (300); the liquid container (230) is generally made of flexible or rigid materials including plastics and metals; the pipe (200) and at least one nozzle (220) is generally constructed of rigid tubular materials including plastics and metals; the wetted salt outlet (320), from the auger container (140), and the container wetted salt outlet (330) are generally apertures; wetted salt outlet (320) and the container wetted salt outlet (330) be formed in joined portions of the auger container (140) and the container (400); the container (400) is generally supported by a truck having tires (420); salt (50) may be comprised of NaCl or combinations of NaCl and $CaCl_2$ and other materials used for roadway surface deicing; Spray nozzles (220) are placed under a protective cover (56) and over the auger (100) system comprised of the auger (100) and auger container (140); the cover (56) provides an environment where the salt (50) and liquid (240) can mix as well as protecting the auger (100) from the weight of the surrounding salt (50); air space (58) is created between the cover (56) and the salt (50) allowing the spray nozzle (220) to atomize the liquid (240) across the salt (50) crystals; the auger (100) mixes the salt (50) and the liquid (240) so that the salt (50), including crystals, can be completely covered, on all sides, with liquid (240); the salt (50) is wetted as liquid (240) is sprayed or atomized onto the auger (100) which is receiving and propelling salt (50); the salt (50) is sprayed with liquid (240) for at least 2 turns of the auger (100) in order to mix the salts (50) crystals with liquid (240); the ratio of liquid (240) to salt (50) is dependent on weather and surface (440) conditions and may be in the range of 15 to 30 gallons of liquid (240) per ton of salt (50); the required liquid (240) content will change depending on the moisture of the salt (50) and the ambient moisture; the amount of time that elapses between the introduction of liquid (240) to the salt (50) and application to a road surface (440) has a dramatic impact on the effectiveness of the resulting wetted salt (50) solution; operators of salt delivery vehicles will control the quantity of liquid (240), the quantity of salt (50), the time the salt (50) is exposed to atomized liquid (240) and the operation and rotation rate of the broadcast spreader (300) by the use of control systems including the use of electronic metering equipment which controls the ratio of liquid (240) to salt (50), the rotation rate of the broadcast spreader (300) and the speed at which the wetted salt slurry (51) mixture is applied to ensure optimum performance; the metering of liquid (240) and salt (50) and control of the rotation rate of the broadcast spreader (300) may be by operator observation which can be facilitated by timing of release of a quantity of liquid (240) while releasing a quantity of salt (50); changing road and weather conditions will require adjustments to the rate of delivery of slurry (51) to the surface (440); a preferred application is 40 gallons of liquid (240) per ton of salt (50), applied at a rate of 40 lbs of salt (50) per mile; the nozzle (220) size and pressure of liquid (240) determines the extent of wetting of salt (50) and the extent to which salt (50) has commenced to dissolve; 0.050" nozzles receiving liquid (240) at 20 psi will deliver 1 gallon of liquid per mile; the nozzles (220) are set about two inches above the top of the auger (100); this separation allows the spray to atomize, thus being more efficient in wetting most to all of the salt (50) crystals; a time requirement is dependent on the rotation rate of the at least one auger (100) and on the pitch and period of the auger (100); the number of turns of the at least one auger (100) will be the number of turns required to wet the salt (50) sufficient to convert the salt (50) to a slurry (51); a range of turns of the at least one auger (100) from 0.5 turns to 2 turns during the time salt (50) is subjected to liquid (240) will cause salt (50) particles to mix or blend; additional turns of the auger (100) will continue the blending process to produce the desired slurry (51); the combination of salt (50) with liquid (240) while mixed by the at least one auger (100) forms a slurry (51) which is deposited on the rotatable broadcast spreader (300) which forms slurry clumps (52) which are deposited on a surface (440); slurry clump (52) size will vary from small droplets to golf ball size clumps (52) generally in a range of 0.1" to 1.25" in diameter with the preferred range of size in the range of 0.25" to 1.25" in diameter; a preferred ratio is one ton of dry road salt (50) to 40 gallons of water (240); operator control is required to deliver desired size and consistency slurry clumps (52) requiring the operator to observe the size of slurry clumps (52) and adjust the combination of the ratio of salt (50) to liquid (240) and the rate of rotation of the broadcast spreader (300) to maintain the consistent application of slurry clumps (52) of the desired size; controls for rate of rotation of the broadcast spreader (300), the pressure of delivered liquid (240) and the delivery rate of salt (50) are generally required.

A process for forming slurry clumps (52), using the apparatus of claim 1 comprises the steps of loading a container (400), generally a truck bed, with salt (50); containing at least one auger (100) within an auger container (140) having a cover (56); metering salt (50) from the container (400), via a salt delivery chute (54) which is in communication with the auger container (140), to at least one auger (100); the at least one auger (100) may be comprised of at least two augers (100) which may be separated by at least one auger container divider (150); the auger container divider (150) comprised by an upstanding planar divider between at least two augers (100); positioning above the at least one auger (100), within the auger container (140), a pipe (200) or pipe (200) system with at least one nozzle (220) downwardly directed toward the at least one auger (100); the at least one nozzle may be multiple nozzles (220); positioning a cover (56) over the pipe (200), auger (100) and auger container (140); the cover (56) and auger container (140) shielding the at least one auger (100) from the introduction of salt (50) other than by delivery from a salt delivery chute (54); composing the salt delivery chute (54), the auger container (140) and cover (56) of rigid materials generally metal; containing liquid (240) in a liquid container (230); the liquid (240) is generally water; delivering the liquid (240) to the pipe (200); the liquid (240) is generally pressurized and is in liquid communication via the pipe (200) with the at least one nozzle (220); rotating the at least one auger (100) by an auger drive (120); introducing the salt (50) to the at least one auger (100) or augers (100), by the salt delivery chute (54); wetting the salt (50) by liquid (240) sprayed, by the at least one nozzle (220) onto the salt (50) as it is mixed and propelled by the augers (100), producing a slurry (51), to a wetted salt outlet (320) from the auger container (140) and through a container wetted salt outlet (330); depositing the slurry (51) on a rotatable broadcast spreader (300); composing the liquid container (230) of flexible or rigid materials including plastics and metals; composing the pipe (200) and at least one nozzle (220) rigid tubular materials including plastics and metals; forming the wetted salt outlet (320), from the auger container (140), and the container wetted salt outlet (330) as apertures; wetted salt outlet (320) and the container wetted salt outlet (330) be formed in joined portions of the auger container (140) and the container (400); the container (400) is generally supported by a truck having tires (420); composing the salt (50) of NaCl or combinations of NaCl and $CaCl_2$ and other materials used for roadway surface deicing; placing the spray nozzles (220) under a protective cover (56) and over the auger (100) system comprised of the auger (100) and auger container (140); the cover (56) provides an environment where the salt (50) and liquid (240) can mix as well as protecting the auger (100) from the weight of the surrounding salt (50); providing an air space (58) between the cover (56) and the salt (50) allowing the spray nozzle (220) to atomize the liquid (240) across the salt (50) crystals; the auger (100) mixing the salt (50) and the liquid (240) so that the salt (50), including crystals, can be completely covered, on all sides, with liquid (240); spraying or atomizing liquid (240) onto the auger (100) which is receiving and propelling salt (50), in a range of turns of the at least one auger (100) for 0.5 to 20 turns of the auger (100) or, in the preferred embodiment, for at least 2 turns of the auger (100) thereby mixing the salts (50) crystals with liquid (240); determining the ratio of liquid (240) to salt (50) is dependent on weather and surface (440) conditions and may be in the range of 15 to 30 gallons of liquid (240) per ton of salt (50); the required liquid (240) content will change depending on the moisture of the salt (50) and the ambient moisture; the amount of time that elapses between the introduction of liquid (240) to the salt (50) and application to a road surface (440) has a dramatic impact on the effectiveness of the resulting wetted salt (50) solution; observing, by an operator(s) of salt delivery vehicles, and controlling the quantity of liquid (240), the quantity of salt (50), the time the salt (50) is exposed to atomized liquid (240) and the operation and rotation rate of the broadcast spreader (300) by the use of control systems including the use of electronic metering equipment which controls the ratio of liquid (240) to salt (50), the rotation rate of the broadcast spreader (300) and the speed at which the wetted salt slurry (51) mixture is applied to ensure optimum performance; metering of liquid (240) and salt (50) and control of the rotation rate of the broadcast spreader (300) may be by operator observation which can be facilitated by timing of release of a quantity of liquid (240) while releasing a quantity of salt (50); adjusting the rate of delivery of slurry (51) to the surface (440) depending on changing road and weather conditions; a preferred application is 40 gallons of liquid (240) per ton of salt (50), applied at a rate of 40 lbs of salt (50) per mile; establishing the nozzle (220) size and pressure of liquid (240) depending on the extent of wetting of salt (50) and the extent to which salt (50) has commenced to dissolve; using 0.010" to 0.1" nozzles with a 0.05" nozzle preferred and receiving liquid (240) at 20 psi will deliver 1 gallon of liquid per mile; setting the nozzles (220) in a range of 0.5" to 12" with a setting of about 2" preferred, above the top of the at least one auger (100); this separation allows the spray to atomize, thus being more efficient in wetting most to all of the salt (50) crystals; determining the time requirement for wetting the salt (50) is dependent on the rotation rate of the at least one auger (100) and on the pitch and period of the auger (100); the number of turns of the at least one auger (100) will be the number of turns required to wet the salt (50) sufficient to convert the salt (50) to a slurry (51); a range of turns of the at least one auger (100) from 0.5 turns to 20 turns with at least 2 turns preferred, during the time salt (50) is subjected to liquid (240) will cause salt (50) particles to mix or blend; additional turns of the auger (100) will continue the blending process to produce the desired slurry (51); combining the salt (50) with liquid (240) while mixed by the at least one auger (100) forms a slurry (51) which is deposited on the rotatable broadcast spreader (300) which forms slurry clumps (52) which are deposited on a surface (440); forming slurry clump (52) sizes from small droplets to golf ball size clumps (52) generally in a range of 0.1" to 1.25" in diameter with the preferred range of size in the range of 0.25" to 1.25" in diameter; setting a preferred ratio of one ton of dry road salt (50) to 40 gallons of water (240); insuring operator control as required to deliver desired size and consistency slurry clumps (52) requiring the operator to observe the size of slurry clumps (52) and adjust the combination of the ratio of salt (50) to liquid (240) and the rate of rotation of the broadcast spreader (300) to maintain the consistent application of slurry clumps (52) of the desired size; controlling the rate of rotation of the broadcast spreader (300), the pressure of delivered liquid (240) and the delivery rate of salt (50) as required for formation of preferred diameter sized slurry clumps (52); forming slurry clumps (52) with the consistency of cooked oatmeal will be a consistency for average conditions.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. An accelerated wetting slurry clump (52) spreading apparatus (1) comprising:

a container (400) containing salt (50); and a salt delivery chute (54) which meters salt (50) from the container (400) to at least one auger (100); and the at least one auger (100) removes salt (50) from the salt container 953); a pipe (200) system with at least one nozzle (220) downwardly directed toward the at least one auger (100); and a liquid container (230) containing a liquid (240), which is delivered to the pipe (200) system; the liquid (240) is in liquid communication via the pipe (200) system with the at least one nozzle (200); the at least one auger (100) is rotated by an auger drive (120),; the salt (50) is introduced to the at least one auger (100), by the salt delivery chute (54), is wetted by liquid (240) sprayed, by the at least one nozzle (220) onto the salt (5) as it is mixed and propelled by the at least one auger (100), producing a slurry (51), to a wetted salt outlet (320) from an auger container (140) and through a container wetted salt outlet (330) where the slurry (51) is then deposited on a rotatable broadcast spreader (300); the liquid container (230) is generally made of flexible or rigid materials; the pipe (200) system and at least one nozzle (220) is generally constructed of rigid tubular materials; and the wetted salt outlet (320), from the auger container (140), and the container wetted salt outlet (330) are apertures; the wetted salt outlet (320) and the container wetted salt outlet (330) are formed in joined portions of the auger container (140) and the container (400); and the at least one nozzle (220) are placed under a protective cover (56) and over the at least one auger (100) and auger container (140); and the salt (50) is wetted as liquid (240) is sprayed or atomized onto the auger (100) which is receiving and propelling salt (50); the salt (50) is sprayed with liquid (240) for 0.5 to 20 turns of the auger (100) in order to mix the salts (50) crystals with liquid (240); the ratio of liquid (240) to salt (50) is in the range of 15 to 40 gallons of liquid (240) per ton of salt (50); and control of the quantity of liquid (240), the quantity of salt (50), the time the salt is exposed to atomized liquid (240) and the operation and rotation rate of the broadcast spreader (300) is by the use of a control system which controls the ratio of liquid (240) to salt (50), the rotation rate of the broadcast spreader (300) and the speed at which the wetted salt slurry (51) mixture is applied;

a time requirement is dependent on the rotation rate of the at least one auger (100) and on a pitch and period of the at least one auger (100); and the combination of salt (50) with liquid (240) while mixed by the at least one auger (100) forms the slurry (51) which is deposited on the rotatable broadcast spreader (300) forming slurry clumps (52) which are deposited on a surface (440); slurry clump (52) size will vary from small droplets to golf ball size clumps (52) generally in a range of 0.1" to 1.25" in diameter; and the control system is required to deliver desired size and consistency slurry clumps (52).

2. An accelerated wetting process for forming slurry clumps (52), using the apparatus of claim 1, for application to a surface (440) comprising:

loading a container (400) with salt (50); and containing at least one auger (100) within an auger container (140) having a cover (56); metering salt (50) from the container (400), via a salt delivery chute (54) which is in communication with the auger container (140), to at least one auger (100); and positioning above the at least one auger (100), within the auger container (140), a pipe (200) system with at least one nozzle (220) downwardly directed toward the at least one auger (100); and positioning a cover (56) over the pipe (200) system, at least one auger (100) and auger container (140); the cover (56) and auger container (140) shielding the at least one auger (100) from the introduction of salt (50) other than by delivery from a salt delivery chute (54); composing the salt delivery chute (54), the auger container (140) and cover (56) of rigid materials generally metal; and containing liquid (240) in a liquid container (230); delivering the liquid (240) to the pipe (200); the liquid (240) is in liquid communication via the pipe (200) with the at least one nozzle (220); rotating the at least one auger (100) by an auger drive (120); introducing the salt (50) to the at least one auger (100), by the salt delivery chute (54); wetting the salt (50) by liquid (240) sprayed, by the at least one nozzle (220) onto the salt (50) as it is mixed and propelled by the at least one auger (100), producing a slurry (51), to a wetted salt outlet (320) from the auger container (140) and through a container wetted salt outlet (330); depositing the slurry (51) on a rotatable broadcast spreader (300); composing the liquid container (230) of flexible or rigid materials including plastics and metals; composing the pipe (200) and at least one nozzle (220) rigid tubular materials including plastics and metals; and forming the wetted salt outlet (320), from the auger container (140), and the container wetted salt outlet (330) as apertures; wetted salt outlet (320) and the container wetted salt outlet (330) is formed in joined portions of the auger container (140) and the container (400); composing the salt (50) of materials used for roadway surface deicing; and placing the at least one spray nozzle (220) under a protective cover (56) and over the at least one auger (100) and auger container (140); the cover (56) provides an environment where the salt (50) and liquid (240) can mix as well as protecting the at least one auger (100) from the weight of the surrounding salt (50); providing an air space (58) between the cover (56) and the salt (50) allowing the at least one spray nozzle (220) to atomize the liquid (240) across the salt (50) crystals; the at least one auger (100) mixing the salt (50) and the liquid (240) so that the salt (50), including crystals, can be completely covered, on all sides, with liquid (240); and spraying or atomizing liquid (240) onto the at least one auger (100) which is receiving and propelling salt (50), in a range of turns of the at least one auger (100) for 0.5 to 20 turns of the at least one auger (100), thereby mixing the salts (50) crystals with liquid (240); determining the ratio of liquid (240) to salt (50) is dependent on weather and surface (440) conditions and may be in the range of 15 to 40 gallons of liquid (240) per ton of salt (50); and controlling the quantity of liquid (240), the quantity of salt (50), the time the salt (50) is exposed to atomized liquid (240) and the operation and rotation rate of the broadcast spreader (300) by the use of control systems which controls the ratio of liquid (240) to salt (50), the rotation rate of the broadcast spreader (300) and the speed at which the wetted salt slurry (51) mixture is applied to ensure optimum performance; and adjusting the rate of delivery of slurry (51) to the surface (440) depending on changing road and weather conditions with the application in the range of 15 to 40 gallons of liquid (240) per ton of salt (50), and establishing the nozzle (220) size and pressure of liquid (240) depending on the extent of wetting of salt (50) and the extent to which salt (50) has commenced to dissolve; setting the nozzles (220) in a range of 0.5" to 12", above the top of the at least one auger (100); this separation allows the spray to atomize, thus being more efficient in wetting most to all of the salt (50) crystals; and determining the time requirement for wetting the salt (50) being dependent on the rotation rate of the at least one auger (100) and on a pitch and period of the at least one auger (100); the number of turns of the at least one auger (100) will be the number of turns required to wet the salt (50) sufficient to convert the salt (50) to a slurry (51); a range of turns of the at least one auger (100) from 0.5 turns to 20 turns, during the time salt (50) is subjected to liquid (240) will cause salt (50) particles to mix or blend; additional turns of the auger (100) will continue the blending process to produce the desired slurry (51); and combining the salt (50) with liquid (240) while mixed by the at least one auger (100) forming a slurry (51) which is deposited on the rotatable broadcast spreader (300) which forms slurry clumps (52) which are deposited on a surface (440); forming slurry clump (52) sizes from small droplets to golf ball size clumps (52) in a range of 0.1" to 1.25" in diameter; and setting a ratio of one ton of dry road salt (50) to liquid (240) in the range of 15 to 40 gallons of liquid (240); insuring control as required to deliver desired size and consistency of slurry clumps (52) and the size of slurry clumps (52) and adjusting the combination of the ratio of salt (50) to liquid (240) and the rate of rotation of the broadcast spreader (300) to maintain the consistent application of slurry clumps (52) of the desired size; controlling the rate of rotation of the broadcast spreader (300), the pressure of delivered liquid (240) and the delivery rate of salt (50) as required for formation of preferred diameter sized slurry clumps (52).

3. An accelerated wetting slurry clump (52) spreading apparatus (1) of claim 1 further comprising:

the container (400) is a salt container (53); the at least one auger (100) is contained in an auger container (140) receiving salt (50) from the salt container (53); and a cover (56) is positioned over the pipe (200) system, the at least one auger (100) and auger container (140); the cover (56) and auger container (140) shields the at least one auger (100) from the introduction of salt (50) other than by delivery from a salt delivery chute (54); the salt delivery chute (54), the auger container (140) and cover (56) are composed of rigid materials; and the liquid (240) is pressurized; the flexible or rigid materials comprising the liquid container (230) are comprised of plastics or metals; the tubular materials comprising the pipe (200) system are plastics or metals; and the salt (50) is sprayed with liquid (240) to form slurry clumps (52) ranging in size from 0.25" to 1.25" in diameter.

4. An accelerated wetting slurry clump (52) spreading apparatus (1) of claim 3 further comprising:

the salt container (53) is a truck bed; and the at least one auger (100) has a cover (56) positioned above the at least one auger (100); the at least one auger (100) contained in an auger container (140) is shielded receiving from salt (50) directly from the salt container (53); and the rigid materials comprising the salt delivery chute (54), the auger container (140) and cover (56) are comprised of metal; and the cover (56) provides an environment where the salt (50) and liquid (240) can mix as well as protect the at least one auger (100) from the weight of the surrounding salt (50); air space (58) is created between the cover (56) and the salt (50) allowing the at least one nozzle (220) to atomize the liquid (240) across the salt (50) crystals; the at least one auger (100) mixes the salt (50) and the liquid (240) so that the salt (50), including crystals, can be completely covered, on all sides, with liquid (240); and the liquid (240) applied is 40 gallons of liquid (240) per ton of salt (50), applied at a rate of 40 lbs of salt (50) per mile; a nozzle (220) size is in the range of 0.010" to 0.1" and pressure of liquid (240), depending on the extent of wetting of salt (50) and the extent to which salt (50) has commenced to dissolve.

5. An accelerated wetting slurry clump (52) spreading apparatus (1) of claim 4 further comprising:

the liquid (240) is water; and the at least one auger (100) is comprised of at least two augers (100); and the container (400) is supported by a truck having tires (420); salt (50) is comprised of materials used for roadway surface deicing; and the nozzle size is 0.05" receiving liquid (240) at 20 psi to deliver 1 gallon of liquid per mile; the at least one nozzle (220) is set above the at least two augers (100) in the range of 0.5" to 12"; and the salt (50) is sprayed with liquid (240) for at least 2 turns of the auger (100); and salt (50) is comprised of NaCl or combinations of NaCl and $CaCl_2$ and other materials used for roadway surface deicing; and the surface (440) is a roadway.

6. The apparatus of claim 5 further comprising:

the control system is by electronic metering equipment which controls the ratio of liquid (240) to salt (50), the rotation rate of the broadcast spreader (300) and the speed at which the wetted salt slurry (51) mixture is applied to ensure optimum performance; and the at least one nozzle (220) is comprised of multiple nozzles (220); and the nozzles (220) are set 2" above the at least two augers (100).

7. The apparatus of claim 5 further comprisiung:

the control system is by operator observation in timing of release of a quantity of liquid (240) while releasing a quantity of salt (50) and adjusting the rate of delivery of slurry (51) to the surface (440) depending on changing road and weather conditions; the operator control system requires the operator to observe the size of slurry clumps (52) and adjust the combination of the ratio of salt (50) to liquid (240) and the rate of rotation of the broadcast spreader (300) to maintain the consistent application of slurry clumps (52) of the desired size; controls are provided for rate of rotation of the broadcast spreader (300), the pressure of delivered liquid (240) and the delivery rate of salt (50); and the at least one nozzle (220) is comprised of multiple nozzles (220); and the nozzles (220) are set 2" above the at least two augers (100).

8. An accelerated wetting slurry clump (52) spreading apparatus (1) of claim 2 further comprising:

the container (400) is a salt container (53); the at least one auger (100) is contained in an auger container (140) receiving salt (50) from the salt container (53); and a cover (56) is positioned over the pipe (200) system, the at least one auger (100) and auger container (140); the cover (56) and auger container (140) shields the at least one auger (100) from the introduction of salt (50) other than by delivery from a salt delivery chute (54); the salt delivery chute (54), the auger container (140) and cover (56) are composed of rigid materials; and the liquid (240) is pressurized; the flexible or rigid materials comprising the liquid container (230) are comprised of plastics or metals; the tubular materials comprising the pipe (200) system are plastics or metals; and the salt (50) is sprayed with liquid (240) to form slurry clumps (52) ranging in size from 0.25" to 1.25" in diameter.

9. An accelerated wetting slurry clump (52) spreading apparatus (1) of claim 8 further comprising:

the salt container (53) is a truck bed; and the at least one auger (100) has a cover (56) positioned above the at least one auger (100); the at least one auger (100) contained in an auger container (140) is shielded receiving from salt (50) directly from the salt container (53); and the rigid materials comprising the salt delivery chute (54), the auger container (140) and cover (56) are comprised of metal; and the cover (56) provides an environment where the salt (50) and liquid (240) can mix as well as protect the at least one auger (100) from the weight of the surrounding salt (50); air space (58) is created between the cover (56) and the salt (50) allowing the at least one nozzle (220) to atomize the liquid (240) across the salt (50) crystals; the at least one auger (100) mixes the salt (50) and the liquid (240) so that the salt (50), including crystals, can be completely covered, on all sides, with liquid (240); and the liquid (240) applied is 40 gallons of liquid (240) per ton of salt (50), applied at a rate of 40 lbs of salt (50) per mile; a nozzle (220) size is in the range of 0.010" to 0.1" and pressure of liquid (240), depending on the extent of wetting of salt (50) and the extent to which salt (50) has commenced to dissolve.

10. An accelerated wetting slurry clump (52) spreading apparatus (1) of claim 9 further comprising:

the liquid (240) is water; and the at least one auger (100) is comprised of at least two augers (100); and the container (400) is supported by a truck having tires (420); salt (50) is comprised of materials used for roadway surface deicing; and the nozzle size is 0.05" receiving liquid (240) at 20 psi to deliver 1 gallon of liquid per mile; the at least one nozzle (220) is set above the at least two augers (100) in the range of 0.5" to 12"; and the salt (50) is sprayed with liquid (240) for at least 2 turns of the auger (100); and salt (50) is comprised of NaCl or combinations of NaCl and $CaCl_2$ and other materials used for roadway surface deicing; and the surface (440) is a roadway; and forming slurry clumps (52) with the consistency of cooked oatmeal.

11. The apparatus of claim 10 further comprising:

the control system is by electronic metering equipment which controls the ratio of liquid (240) to salt (50), the rotation rate of the broadcast spreader (300) and the speed at which the wetted salt slurry (51) mixture is applied to ensure optimum performance; and the at least one nozzle (220) is comprised of multiple nozzles (220); and the nozzles (220) are set 2" above the at least two augers (100).

12. The apparatus of claim 10 further comprisiung:

the control system is by operator observation in timing of release of a quantity of liquid (240) while releasing a quantity of salt (50) and adjusting the rate of delivery of slurry (51) to the surface (440) depending on changing road and weather conditions; the operator control system requires the operator to observe the size of slurry clumps (52) and adjust the combination of the ratio of salt (50) to liquid (240) and the rate of rotation of the broadcast spreader (300) to maintain the consistent application of slurry clumps (52) of the desired size; controls are provided for rate of rotation of the broadcast spreader (300), the pressure of delivered liquid (240) and the delivery rate of salt (50); and the at least one nozzle (220) is comprised of multiple nozzles (220); and the nozzles (220) are set 2" above the at least two augers (100).

* * * * *